United States Patent [19]

Sato et al.

[11] Patent Number: 4,626,195

[45] Date of Patent: Dec. 2, 1986

[54] LOW LOAD BURNING BURNER

[75] Inventors: Kuniaki Sato; Shinichiro Muto, both of Chiba; Noriaki Wako, Yokohama, all of Japan

[73] Assignees: Kawasaki Steel Corporation, Kobe; Nippon Furnace Kogyo Kaisha, Ltd., Tokyo, both of Japan

[21] Appl. No.: 732,244

[22] Filed: May 8, 1985

[30] Foreign Application Priority Data

May 9, 1984 [JP] Japan ..... 59-91074

[51] Int. Cl.[4] ..... F23M 9/00

[52] U.S. Cl. ..... 431/188; 431/12; 431/284; 432/9

[58] Field of Search ..... 431/8, 174, 177–179, 431/181–188, 252, 284, 12; 432/9, 11, 12; 239/400, 418, 422, 423, 424

[56] References Cited

U.S. PATENT DOCUMENTS

| | | | |
|---|---|---|---|
| 1,792,021 | 2/1931 | Loftus . | |
| 1,953,590 | 4/1934 | Cone | 431/185 |
| 4,281,984 | 8/1981 | Kobayashi et al. | 431/185 X |

FOREIGN PATENT DOCUMENTS

| | | | |
|---|---|---|---|
| 2415096 | 10/1974 | Fed. Rep. of Germany | 431/8 |
| 699705 | 11/1953 | United Kingdom . | |

*Primary Examiner*—Margaret A. Focarino
*Attorney, Agent, or Firm*—Balogh, Osann, Kramer, Dvorak, Genova & Traub

[57] ABSTRACT

A low load burning burner comprising inner air flow nozzles, outer air flow nozzles and a fuel gas nozzle, and further having a motive air supply means, which is operated at the low load burning of a heating furnace, can maintain the furnace temperature uniform, and can heat materials arranged in the width direction of the furnace to a uniform temperature along the width direction of the furnace.

1 Claim, 7 Drawing Figures

LOW LOAD BURNING BURNER

BACKGROUND OF THE INVENTION (1) Field of the Invention

The present invention relates to a structure of burner, and more particularly to a structure of burners arranged on both sidewalls of a heating furnace having a relatively large width for heating a material conveyed from the inlet side to the outlet side of the furnace by means of a transporting means. The burner has a structure wherein a fuel gas is jetted into a heating furnace while being sandwiched between an inner air flow and an outer air flow to form a hollow flame in the furnace.

(2) Description of the Prior Art:

The inventors have already proposed in U.S. Pat. No. 4,281,984, a burner which forms a hollow flame by fuel gas. FIGS. 4 and 5 in the accompanying drawings illustrate the burner. That is, FIG. 4 is a sectional side view of the burner, and FIG. 5 is its front view viewed from the combustion furnace side.

Referring to FIGS. 4 and 5, a proper amount of air based on the amount of supplied fuel is supplied to the burner through a supply passage 1. The supply passage 1 is branched into an inner air flow passage 2 and an outer air flow passage 3. Air flow rate controlling dampers 4 and 5 are arranged in the inner and outer air flow passages 2 and 3, respectively. A baffle 7 is arranged at the end of an inner air flow supply pipe 6 formed in the center axis portion of the burner and has a relatively large area center portion, and several number of inner air flow nozzles 8, 8' . . . are arranged in the peripheral portion of the baffle 7. An annular outer air flow supply pipe 9 is formed in the peripheral portion of the burner, and has an annular baffle 10 at the end, and the annular baffle 10 has several number of outer air flow nozzles 11, 11' . . . .

Fuel gas, which has been controlled to a proper flow rate corresponding to the load of burner, is supplied from a supply passage 12, is flowed through a fuel gas supply pipe 13 arranged between the inner air flow supply pipe 6 and the outer air flow supply pipe 9 and having an annular cross-section, and then is jetted straightforwardly into the furnace through an annular fuel gas nozzle 14 arranged between an inner air flow baffle 7 and the outer air flow baffle 10 arranged at the end of the inner and outer air flow supply pipes. That is, fuel gas is jetted while being sandwiched between the inner air flow and the outer air flow, to form a hollow flame.

The burner illustrated in FIGS. 4 and 5 has the following characteristic properties.

(1) The ratio of the inner air flow rate to the outer air flow rate can be changed, whereby the length of flame can be changed.

(2) The swirl angle of inner air flow jet and that of outer air flow jet can be set to proper swirl angles, whereby a hollow flame having a desired shape can be formed.

(3) In the burning, a hollow flame is formed, and therefore generation of $NO_x$ is very small.

(4) A perfect combustion can be carried out even in a low excess air ratio.

(5) Fuel gas can be burnt while keeping the flame stable. A large number of the burners illustrated in FIGS. 4 and 5 can be arranged on both sidewalls of a heating furnace having a large width, and the furnace can be operated while keeping the furnace temperature to a desired temperature and keeping the temperature in the width direction of the furnace to a uniform temperature. Therefore, the heating time of the material to be heated can be shortened, and the thermal efficiency can be improved.

For example, in the case where the burner illustrated in FIGS. 4 and 5 is operated under a rated load, when the swirl angle of the inner air flow jet is designed to 60°, and the ratio of the inner air flow rate to the total air flow rate is set to 35%, the resulting flame is a short flame having a length of 1.5 m, while when the swirl angle of the inner air flow jet is designed to 60° similarly to the above, and the ratio of the inner air flow rate to the total air flow rate is set to 0%, the resulting flame is a long flame having a length of 4.5 m.

However, recent operation of a heating furnace must be carried out under various conditions.

For example, a material to be heated is heated in a heating furnace sometimes at a taking out temperature of 1,200° C. or sometimes at a taking out temperature of 800° C. Further, a material to be heated is sometimes supplied to a heating furnace directly from a casting site under red heat, or is sometimes supplied to a heating furnace after cooled to room temperature. Furthermore, the burning air is sometimes previously heated up to 700° C. or is sometimes kept to a temperature considerably lower than 700° C.

The heating furnace must be often operated under a low load of about 10% based on the rated load.

In order to adapt a heating furnace of this low load operation, some of the burners arranged on both sidewalls of the heating furnace are often stopped. However, such operation system, wherein burners are operated and stopped repeatedly, is not a desirable operation from the viewpoint of safeness, and further is complicated in its burning system, is apt to cause leakage of air, and is low in the thermal efficiency.

When it is intended to carry out a low load burning of about 10% based on the rated load by means of a burner illustrated in FIGS. 4 and 5, the following drawbacks occur. That is, the flame becomes always short, the furnace temperature becomes low in the center portion of the furnace, and a uniform heating in the furnace width direction can not be carried out.

SUMMARY OF THE INVENTION

The object of the present invention is to provide a burner free from the above described drawbacks in the low load burning of a heating furnace. That is, the burner of the present invention is a burner adapted for low load burning, which can form a uniform temperature distribution in the width direction of a heating furnace at the low load burning of about 10% based on the rated load of the burners arranged on both sidewalls of the heating furnace, and can heat uniformly an object material arranged in the width direction of the furnace.

The feature of the present invention is the provision of a low load burning burner comprising several number of inner air flow nozzles 8, 8' . . . , several number of outer air flow nozzles 11, 11', . . . , and a fuel gas nozzle 14; said inner air flow nozzles 8, 8', . . . being arranged in the peripheral portion of an inner air flow baffle 7 arranged at the end of the center axis portion of the burner and having a relatively large area center portion; said outer air flow nozzles 11, 11', . . . being arranged in an annular outer air flow baffle 10 arranged at the end of the peripheral portion of the burner; and said fuel gas nozzle 14 being constituted by an annular region, which is formed between the inner air flow baffle 7 and the outer air flow baffle 10, such that the fuel gas can be jetted straightforwardly into the furnace through the nozzle, the improvement comprising a motive air supply means, which comprises a branched passage 15, a flow rate control valve 16 and a pressurizing fan 17, and is operated during the low load burning of the burner so as to change the branched air flow into a motive air, to supply a proper amount of the motive air under a proper pressure and to jet the motive air straightforwardly through a motive air nozzle 19 arranged in the inner air flow baffle 7, in the outer air flow baffle 10 or in the fuel gas nozzle 14 region.

BRIEF DESCRIPTION OF THE DRAWINGS

For a better understanding of the invention, reference is taken to the accompanying drawings, wherein.

DESCRIPTION OF THE PREFERRED EMBODIMENT

Figure 1:
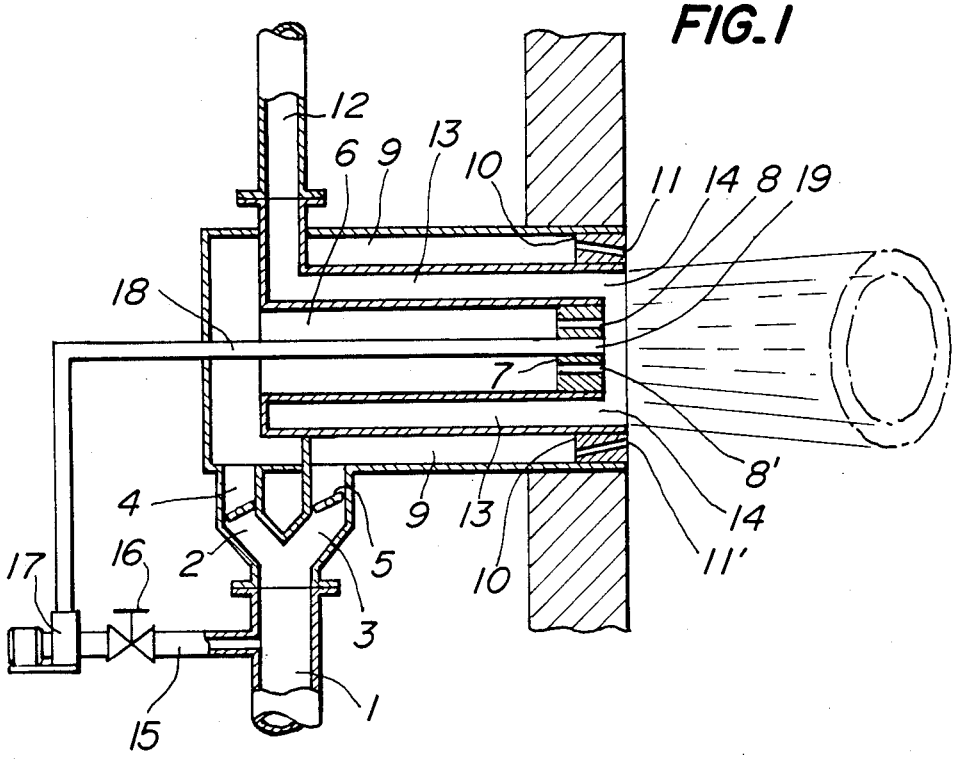
FIG. 1 is a sectional side view of a low load burning burner according to the present invention.
Figure 4:
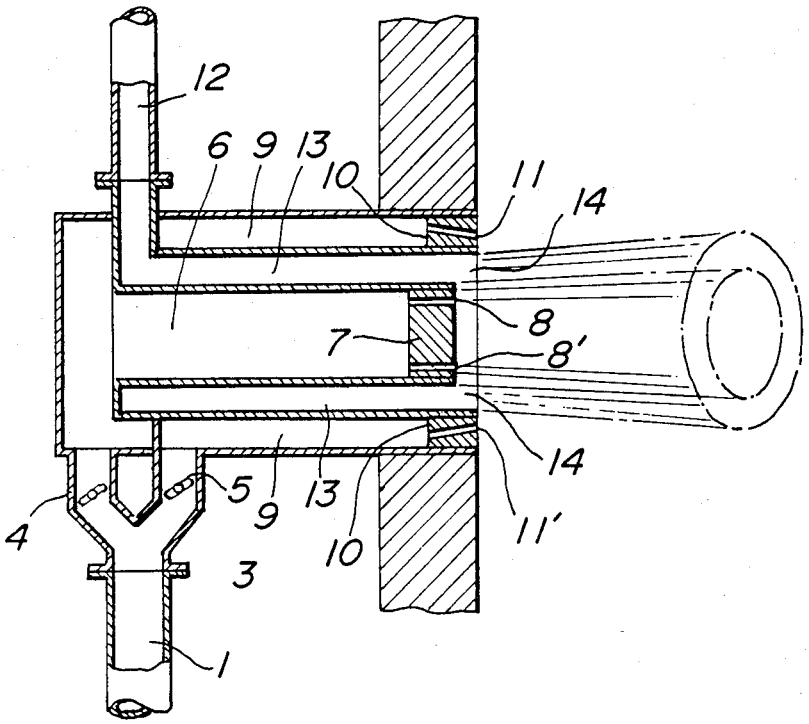
FIG. 4 PRIOR ART
FIG. 4 is a sectional side view of a conventional burner, which was developed by the inventors as a side burner of a heating furnace and disclosed in U.S. Pat. No. 4,281,984.
Figure 5:
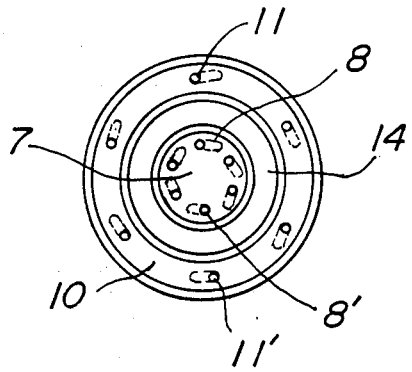
FIG. 5 PRIOR ART
FIG. 5 is a front view of the burner illustrated in FIG. 4, viewed from the combustion chamber side.

The present invention directs to an improvement of a burner, for example, illustrated in FIGS. 4 and 5. FIG. 1 is a sectional side view of a burner according to the present invention, and FIG. 2 is a front view of the burner illustrated in FIG. 1, viewed from the combustion chamber side.

Figure 2:
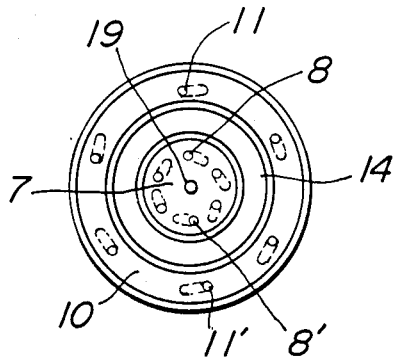
FIG. 2 is a front view of the burner illustrated in FIG. 1, viewed from the combustion chamber side.

Referring to FIGS. 1 and 2, a branched passage 15 is formed from the upstream position of a branch point of an air supply passage 1 into an inner air flow passage 2 and an outer air flow passage 3, and a flow rate control valve 16 is arranged in the branched passage 15. A pressurizing fan 17 is arranged on the delivery side of the valve 16 and converts the branched air flow coming out from the valve 16 into a motive air. The motive air delivered from the fan 17 is passed through a motive air supply pipe 18, and jetted into a heating furnace through a motive air nozzle 19 arranged at the end of the motive air supply tube 18. The term "motive air" herein used means an auxiliary air which gives a straightforwardly advancing movement to a flame. By the action of this motive air, a satisfactorily long flame length can be obtained even in a burning under a low load of about 10% based on the rated load. As the result, the lowering of the temperature in the center portion of a heating furnace can be prevented and a uniform temperature distribution in the furnace along its width direction can be obtained. The motive air nozzle 19 is arranged in the inner air flow baffle 7, in the outer air flow baffle 10 or in a fuel gas nozzle 14 region, and is preferably arranged at the position above the center of the baffle 7 or 10, or of the fuel gas nozzle 14 region. When the load applied to the burner is decreased to a low load of 15% or less based on the rated load, the above described fan 17 is automatically operated to supply a proper amount of motive air to the motive air supply tube 18 under a proper pressure. For example, the pressurizing fan 17 has been automatically controlled such that about 3.6%, based on the rated amount, of air is pressurized to about 300 mmHg and supplied to the motive air supply tube 18.

The effect of the low load burning burner of the present invention will be explained hereinafter.

Figure 3:
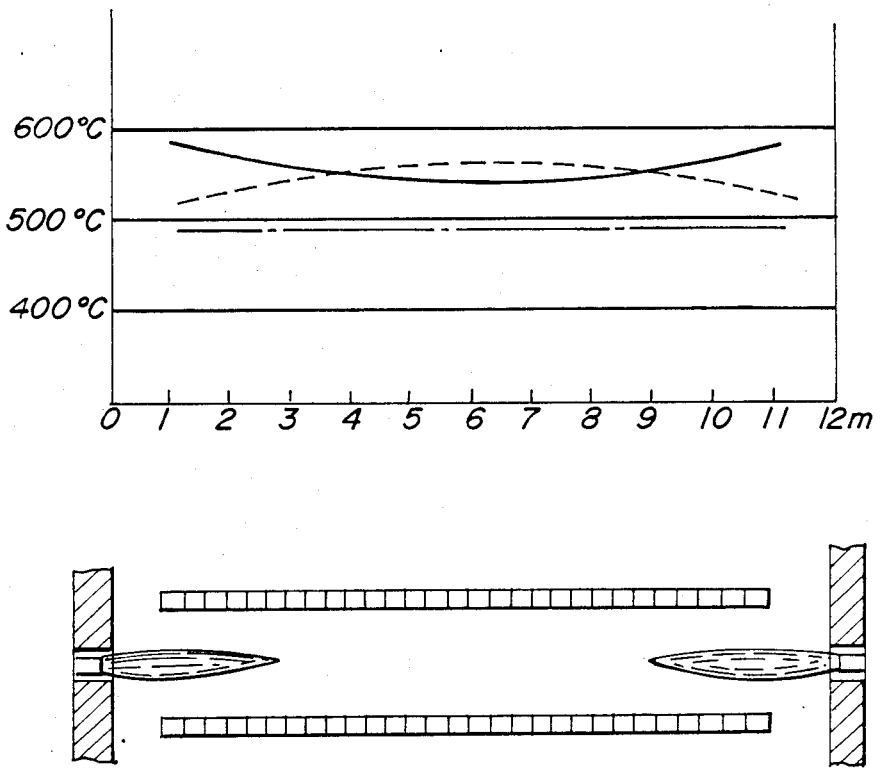
FIG. 3 is a graph illustrating a temperature (solid line) in a heating furnace having a width of 12 m and temperatures (dotted line and dot-dash line) of materials arranged and heated in the furnace in an experiment wherein the burners of the present invention illustrated in FIGS. 1 and 2 are oppositely arranged on both sidewalls of the heating furnace, and are burnt under a low load of 10% based on the rated load.

FIG. 3 shows the result of an experiment for measuring the effect of the burner of the present invention. In the experiment, two burners of the present invention illustrated in FIGS. 1 and 2 were oppositely arranged on both sidewalls of a heating furnace having a width of 12 mm as illustrated in FIG. 3, and a large number of materials to be heated are arranged in the furnace in its width direction at a position 1.1 m above the line connecting the burners and at a position 0.7 m beneath the line as illustrated in FIG. 3, and heated by burning the burners under a low load of 10% based on the rated load. In FIG. 3, the solid line shows the furnace temperature, the dotted line shows the temperature of the materials arranged above the line connecting the burners and heated, and the dot-dash line shows the temperature of the materials arranged beneath the line and heated in the above described experiment.

Figure 6:
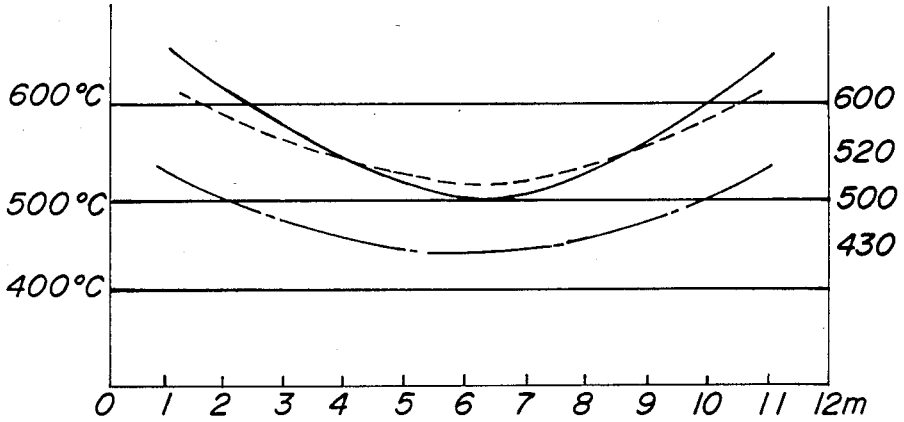
FIG.6 PRIOR ART
FIG. 6 is a graph illustrating a temperature (solid line) in a heating furnace having a width of 12 m and temperatures (dotted line and dot-dash line) of materials arranged and heated in the furnace in an experiment, which has been carried out for the comparison with the experiment shown in FIG. 3, and wherein the conventional burners illustrated in FIGS. 4 and 5 are oppositely arranged on both sidewalls of the furnace and are burnt under a low load of 10% based on the rated load.
Figure 6:
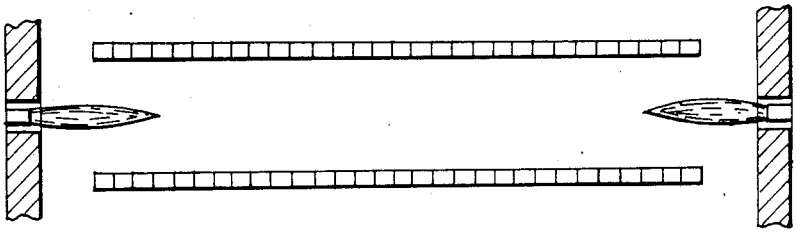
FIG.6 PRIOR ART

FIG. 6 shows the result of an experiment for measuring the effect of the conventional burner, which experiment has been carried out correspondingly to the experiment of FIG. 3 in order to compare the effect of the burner of the present invention with that of the conventional burner. That is, in this experiment, two conventional burners illustrated in FIGS. 4 and 5 were arranged on both sidewalls of a heating furnace heating a width of 12 m as illustrated in FIG. 6, and a large number of materials to be heated are arranged in the furnace in its width direction at a position 1.1 m above the line connecting the burners and at a position 0.7 m beneath the line as illustrated in FIG. 6, and heated by burning the burners under a low load of 10% based on the rated load. In FIG. 6, the solid line shows the furnace temperature, the dotted line shows the temperature of the materials arranged above the line connecting the burners and heated, and the dot-dash line shows the temperatures of the materials arranged beneath the line and heated in the above described experiment.

The burning conditions of the experiments of FIGS. 3 and 6 are shown in the following Table 1.

That is, in both the experiments, fuel gas was flowed at a rate of 100 $Nm^3/hr$, which was 10% based on the rated flow rate of 1,000 $Nm^3/hr$, and air was flowed at an air-fuel ratio of 2.5, that is, the flow rate of total air was 250 $Nm^3/hr$.

In the use of the burner of the present invention, the air was flowed such that an outer air was flowed at a rate of 160 $Nm^3/hr$ (at 5 mm $H_2O$), an inner air was not flowed (flow rate: 0 $Nm^3/hr$), and a motive air was pressurized to 300 mm $H_2O$ and flowed at a rate of 90 $Nm^3/hr$. While, in the use of the conventional burner, the air was flowed such that the total air was flowed as an outer air at a rate of 250 $Nm^3/hr$ (at 10 mm $H_2O$), and an inner air was not flowed (flow rate: 0 $Nm^3/hr$).

TABLE 1

| | Burner of this invention (experiment of FIG. 3) | Conventional burner (experiment of FIG. 6) |
|---|---|---|
| Flow rate of fuel gas (10% based on the rated flow rate) | 100 $Nm^3/hr$ · burner (max. 1,000 $Nm^3/hr$) | |
| Flow rate of air | | |
| Outer air | 160 $Nm^3/hr$ (supply pressure: 5 mm $H_2O$) | 250 $Nm^3/hr$ (supply pressure: 10 mm $H_2O$) |
| Inner air | 0 $Nm^3/hr$ | 0 $Nm^3/hr$ |
| Motive air | 90 $Nm^3/hr$ (supply pressure: 300 mm $H_2O$) | — |

Figure 7:
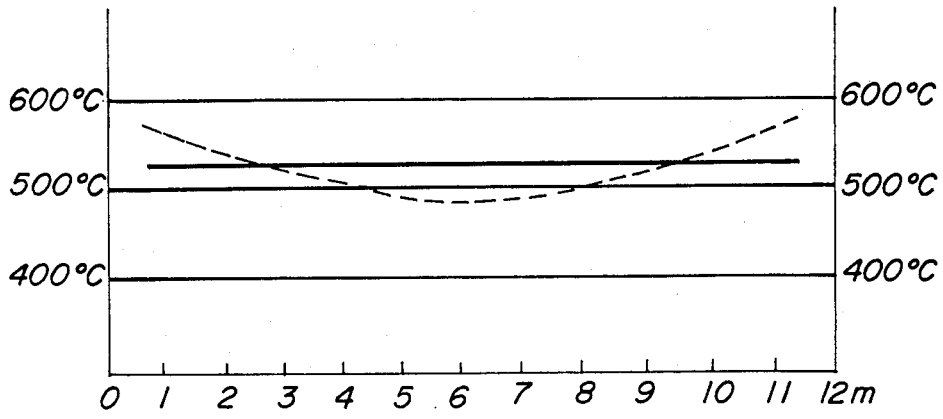
FIG. 7 is a graph illustrating a deduced temperature distribution in the heated materials in an experiment, wherein materials to be heated are conveyed in a heating furnace having a width of 12 m in a direction perpendicular to the plane of the drawing from its surface side towards its back side, and are heated in the furnace by means of upper burners and lower burners arranged on both sidewalls of the furnace; the solid line indicating a deduced temperature distribution in the materials heated by the use of the burners of the present invention, and the dotted line indicating the deduced temperature distribution in the materials heated by the use of the conventional burners.
Figure 7:
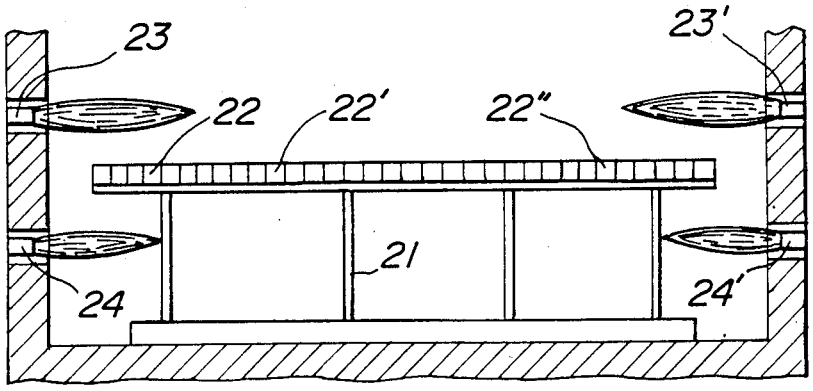

In a practical heating furnace, as illustrated in FIG. 7, materials 22, 22', . . . to be heated are arranged between both sidewalls of the furnace and conveyed in the furnace by means of a transporting means 21 in a direction perpendicular to the plane of the drawing from its surface side towards its back side. Upper burners 23 and 23' and lower burners 24 and 24' are arranged on both sidewalls of the heating furnace, and the materials to be heated are heated, during the moving in the furnace, at their upper surface by means of the upper burners 23 and 23' and at their lower surface by means of the lower burners 24 and 24'.

FIG. 7 shows the temperature distribution in the materials heated by the burners under a low load of 10% based on the rated load. In FIG. 7, the solid line shows the temperature distribution in the heated materials, which temperature distribution is deduced from the experimental value of FIG. 3 in the case where the burners of the present invention are used as the upper burners and the lower burners; and the dotted line shows the temperature distribution in the heated materials, which temperature distribution is deduced from the experimental value of FIG. 6 in the case where the conventional burners are used as the upper burners and the lower burners.

The burning condition in FIG. 7 is the same as that described in Table 1.

it can be seen from FIG. 7 that, when conventional burners are used and burnt under a low load of 10% based on the rated load, a temperature difference of 70° C. is caused between the temperature of the materials arranged and heated in the center portion of the heating furnace and that of the materials arranged and heated in both the side portions thereof as indicated by the dotted line; and when the burners of the present invention are used and burnt under a low load of 10% based on the rated load, there is substantially no temperature difference among the materials heated in the furnace as indicated by the solid line, and all the object materials heated to the desired temperature can be taken out from the heating furnace.

What is claimed is:

1. In a low load burning burner comprising inner and outer air flow passages, inner and outer air supply pipes, several number of inner air flow nozzles, and several number of outer air flow nozzles, being connected to said inner and outer air flow passages through the inner and outer air supply pipes, respectively, a fuel gas supply passage, a fuel gas supply pipe, and a fuel gas nozzle being connected to said fuel gas supply passage through the fuel gas supply pipe, said inner air flow nozzles being arranged in the peripheral portion of an inner air flow baffle arranged at the end of the center axis portion of the burner and having a relatively large area center portion, said outer air flow nozzles being arranged in an annular outer air flow baffle arranged at the end of the peripheral portion of the burner, and said fuel gas nozzle being constituted by an annular region, which is formed between the inner air flow baffle and the outer air flow baffle, such that the fuel gas can be jetted straightforwardly into the furnace through the nozzle, the improvement comprising a motive air supply means, which comprises a branched passage, a flow rate control valve and a pressurizing fan, and is operated at the low load burning of the burner so as to supply a proper amount of a motive air under a proper pressure and to jet the motive air straightforwardly through a motive air nozzle arranged in the inner air flow baffle, in the outer air flow baffle or in the fuel gas nozzle region.

* * * * *